US006164206A

United States Patent [19]

Yoshida

[11] Patent Number: 6,164,206

[45] Date of Patent: Dec. 26, 2000

[54] IMAGE FORMING APPARATUS AND CONTROLLING METHOD THEREOF

[75] Inventor: Masahito Yoshida, Shiki, Japan

[73] Assignee: Canon Kabushiki Kaisha, Tokyo, Japan

[21] Appl. No.: 09/396,882

[22] Filed: Sep. 16, 1999

[30] Foreign Application Priority Data

Sep. 18, 1998 [JP] Japan ..... 10-282065
Sep. 6, 1999 [JP] Japan ..... 11-251969

[51] Int. Cl.[7] ..... B41F 1/54

[52] U.S. Cl. ..... 101/484; 400/642; 400/708; 347/104

[58] Field of Search ..... 101/484; 400/625, 400/605, 642, 668, 708, 708.1; 347/104, 3, 37

[56] References Cited

U.S. PATENT DOCUMENTS 5,019,839 5/1991 Watanabi et al. ..... 400/642
5,627,570 5/1997 Hiramatsu et al. ..... 347/37
5,668,581 9/1997 Tsuji et al. ..... 347/37
5,731,829 3/1998 Saito et al. ..... 400/605
5,767,884 6/1998 Bortolotti et al. ..... 347/104
5,808,647 9/1998 Kurata et al. ..... 347/104
5,917,518 6/1999 Ohashi et al. ..... 347/37
5,980,141 11/1999 Donnis ..... 400/625
6,027,269 2/2000 Yoshida ..... 347/104
6,091,514 7/2000 Hasegawa et al. ..... 347/3

*Primary Examiner*—Eugene Eickholt
*Attorney, Agent, or Firm*—Fitzpatrick, Cella, Harper & Scinto

[57] ABSTRACT

An image forming apparatus including an image forming device for forming an image on a sheet, a discharging device for discharging the sheet on which the image is formed by the image forming device, a containing portion for containing the sheet discharged from the discharging device, a sheet holding device capable of holding the sheet before the discharged sheet is contained in the containing portion, and a switching device for switching the holding of the sheet holding device for the sheet in response to an image forming method of the sheet.

32 Claims, 10 Drawing Sheets

IMAGE FORMING APPARATUS AND CONTROLLING METHOD THEREOF

BACKGROUND OF THE INVENTION

1. Field of the Invention

The present invention relates to an image forming apparatus such as an ink jet printer for effecting printing by discharging liquid ink onto a printing medium, and a discharged sheet stacking apparatus associated with such an image forming apparatus and having a function of preventing a print surface of a printed sheet (before ink fixing) from abrading, and a control method therefor.

2. Related Background Art

Recently, ink jet printers have widely been applied to personal computers, word processors and facsimiles because of their high speed printing abilities and high print quality.

A typical construction of an ink jet printer is shown in FIG. 10.

In the typical ink jet printer, a printing operation is effected in such a manner that a carriage 1 on which a head for discharging ink in a z-direction is mounted scans a sheet 2 (being conveyed) along a y-direction perpendicular to a sheet conveying direction x.

The sheet 2 is intermittently conveyed by a conveying roller 3 by an amount corresponding to a length printed by one scanning of the carriage 1, and the printing operation is continued by repeating the scanning of the carriage 1 and the sheet conveyance of the conveying roller 3.

The entire printing time is mainly determined by a sheet conveying speed and a scanning speed of the carriage 1.

Further, the sheet conveying speed is determined by the ability of a sheet conveying mechanism and the ability of a drive source therefor.

Although depending upon the abilities of a scanning mechanism and a drive source therefor, the scanning speed of the carriage 1 is mainly determined by the property of ink regarding the head, and ink discharging ability determined by heaters (discharging means) mounted on the head and other elements, i.e., ink discharging amount per unit time.

Further, in the ink jet printer, an operator can select a print mode.

Print modes which are normally provided in the apparatus and which can be selected by the operator include a high speed print mode for improving the printing speed, a high image quality print mode which attaches importance to the printing speed, and a high image quality print mode which attaches importance to image quality. And, in some printers, these modes are divided into several stages.

In the high speed print mode, it is required that the scanning speed of the carriage 1 be increased while utilizing the ink discharging ability of the head to the maximum.

To achieve this, for example, ink discharging numbers per one scanning of the carriage 1 are usually reduced to ½ to cope with the high scanning speed of the carriage 1.

As a result, in the high speed print mode, although the resolving power of image and print density are decreased in comparison with other modes, the important high printing speed feature can be obtained.

On the other hand, in the high image quality print mode, since the resolving power of image can be improved and overlapping print is effected to reduce unevenness of sheet conveyance, the scanning speed of the carriage 1 is decreased and the scanning numbers are increased, with the result that the printing speed tends to be decreased.

Further, in the ink jet printer, since the printing is effected by discharging the liquid ink onto the sheet, if a succeeding printed sheet is stacked to contact a print surface of the preceding printed sheet before the ink on the surface of the preceding printed sheet is dried and fixed, the print surface of the preceding sheet will be contaminated by ink.

To avoid this, in the conventional ink jet printer, a heater is incorporated in the apparatus to promote the drying of the print surface of the sheet or a discharged sheet stacking device is provided as a means for preventing the succeeding sheet from overlapping or abrading before the ink printed on the surface of the preceding sheet is dried and fixed in the continuous printing.

FIG. 11 is a perspective view of a conventional ink jet printer having a discharged sheet stacking device.

As shown in FIG. 11, in a printer 4, a sheet 2 is conveyed by an internal sheet conveying mechanism (not shown) as the printing operation progresses and is discharged from a sheet discharging port 5.

The sheet 2 discharged from the sheet discharging port 5 temporarily rests on two movable support members 7 arranged in a discharged sheet stacking portion (containing portion) 6 which is disposed at a downstream side of the sheet discharge port 5 in a sheet discharging direction and on which the printed sheets are ultimately stacked. The support members 7 can be moved between a first position where the sheets are held by the support members 7 and a second position where the sheets are not held by the support members 7.

FIG. 12 is a front view of the discharged sheet stacking device.

Since the sheet 2 is held by the support members 7 in a spaced relationship to a previously printed sheet 8 stacked on the discharged sheet stacking portion 6 until a time period required for drying the ink on the previous sheet 8 elapses, the sheet 2 is prevented from overlapping or abrading with respect to the previous sheet 8.

After the time period for drying the previous sheet 8 has elapsed, two support members 7 are spaced apart from each other by a distance greater than a width of the sheet by a cam or other means (not shown) for driving the support members 7, with the result that the held sheet 2 is dropped and is stacked on the previous sheet 8 resting on the discharged sheet stacking portion 6.

Since the sheet is stacked onto the discharged sheet stacking portion 6 after the time period required for drying the ink (time period for printing one sheet or more) has elapsed, the contamination of the print surface of the sheet due to overlapping or abrading between the sheets can be prevented. If a further drying time period is required, the printing of the next sheet can be stopped while holding the sheet 2.

The time period required for drying the ink is closely associated with print density on the sheet. Namely, the higher the print density (i.e., the greater the ink amount) the longer the fixing time (i.e., longer than the drying time).

On the other hand, if the density is reduced by decreasing the resolving power, the amount of ink used also decreases to shorten the fixing time.

However, in the above-mentioned conventional technique, the following problems arose.

In case of the conventional ink jet printer and the discharged sheet stacking device having the above-mentioned constructions, an operation of the discharged sheet stacking device is incorporated in the series of printing operations so that the discharged sheet stacking device performs holding, releasing and stacking of the printed sheet in any mode.

Accordingly, in comparison with the printer having no discharged sheet stacking device, the printing speed tends to decrease due to the presence of the operation of the discharged sheet stacking device, and, particularly in the high speed print mode, the requirement of the operator cannot be satisfied.

SUMMARY OF THE INVENTION

The present invention aims to eliminate the above-mentioned conventional drawbacks, and an object of the present invention is to provide a discharged sheet stacking device, an image forming apparatus and a controlling method therefor, in which processing speed is improved.

DETAILED DESCRIPTION OF THE PREFERRED EMBODIMENTS

The present invention will now be fully explained in connection with embodiments thereof with reference to the accompanying drawings. However, dimensions, materials, configurations and relative positions of constructural elements described in the embodiments do not limit the present invention, except for special definition.

(First Embodiment)

Now, a discharged sheet stacking device, an image forming apparatus and a controlling method thereof, according to a first embodiment of the present invention will be described with reference to FIGS. 1 to 7.

Figure 10:
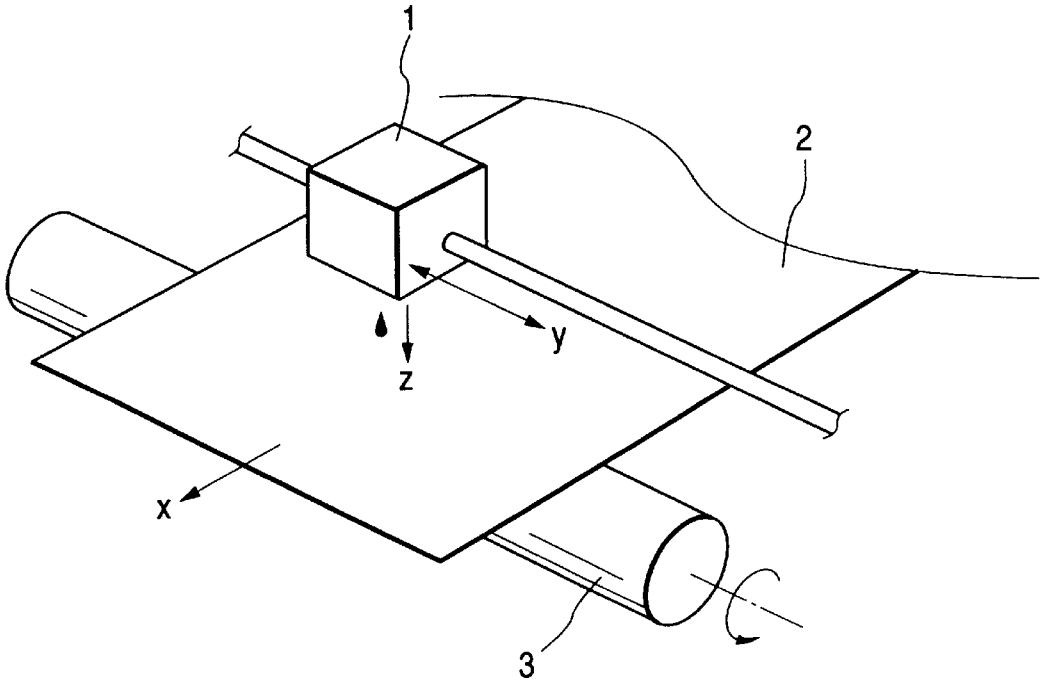
FIG. 10 is an explanatory view showing an ink jet printer.
Figure 11:
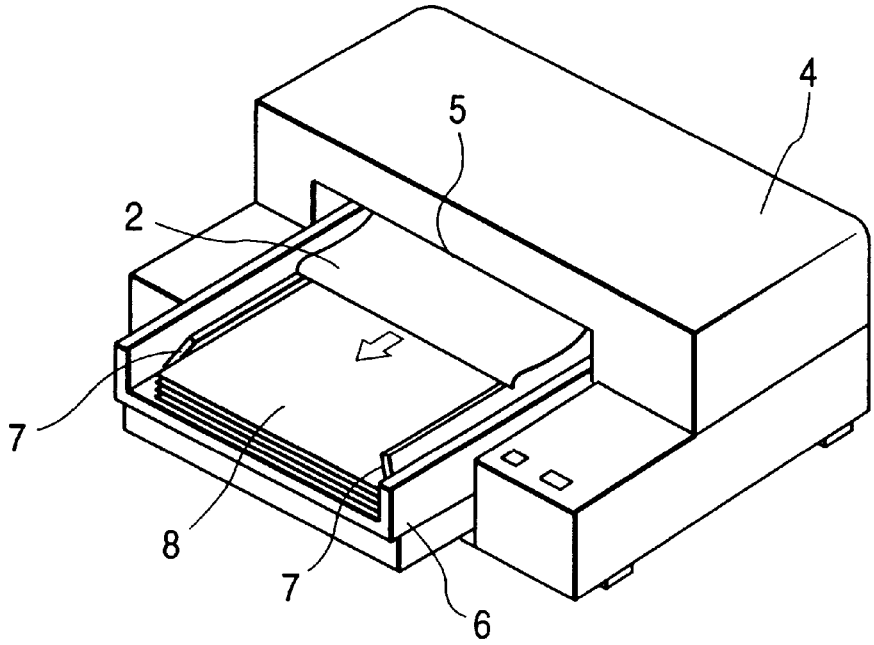
FIG. 11 is a perspective view of an ink jet printer device having a discharged sheet stacking device.
Figure 12:
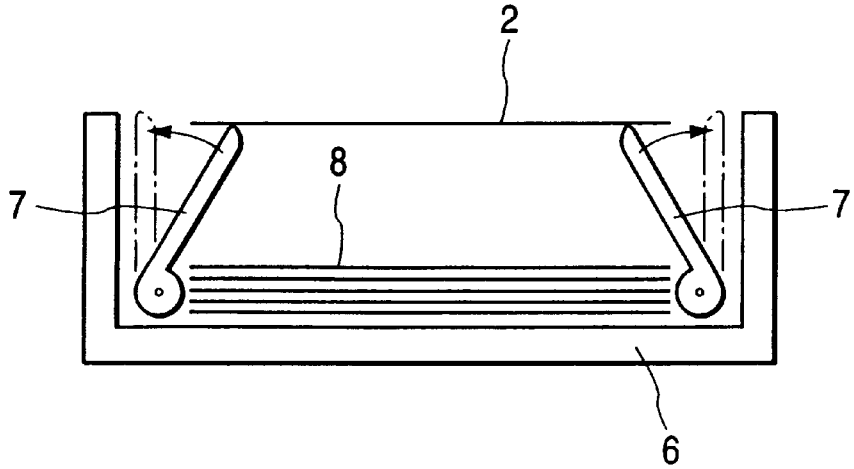
FIG. 12 is a front view of the discharged sheet stacking device.

Incidentally, since the entire construction of the image forming apparatus such as an ink jet printer is well-known, explanation thereof will be omitted, and, further, since fundamental constructions of the discharged sheet stacking device and the image forming apparatus according to the first embodiment are the same as those of the conventional technique described in connection with FIGS. 10 to 12, the same elements are designated by the same reference numerals and explanation thereof will be omitted.

Figure 1:
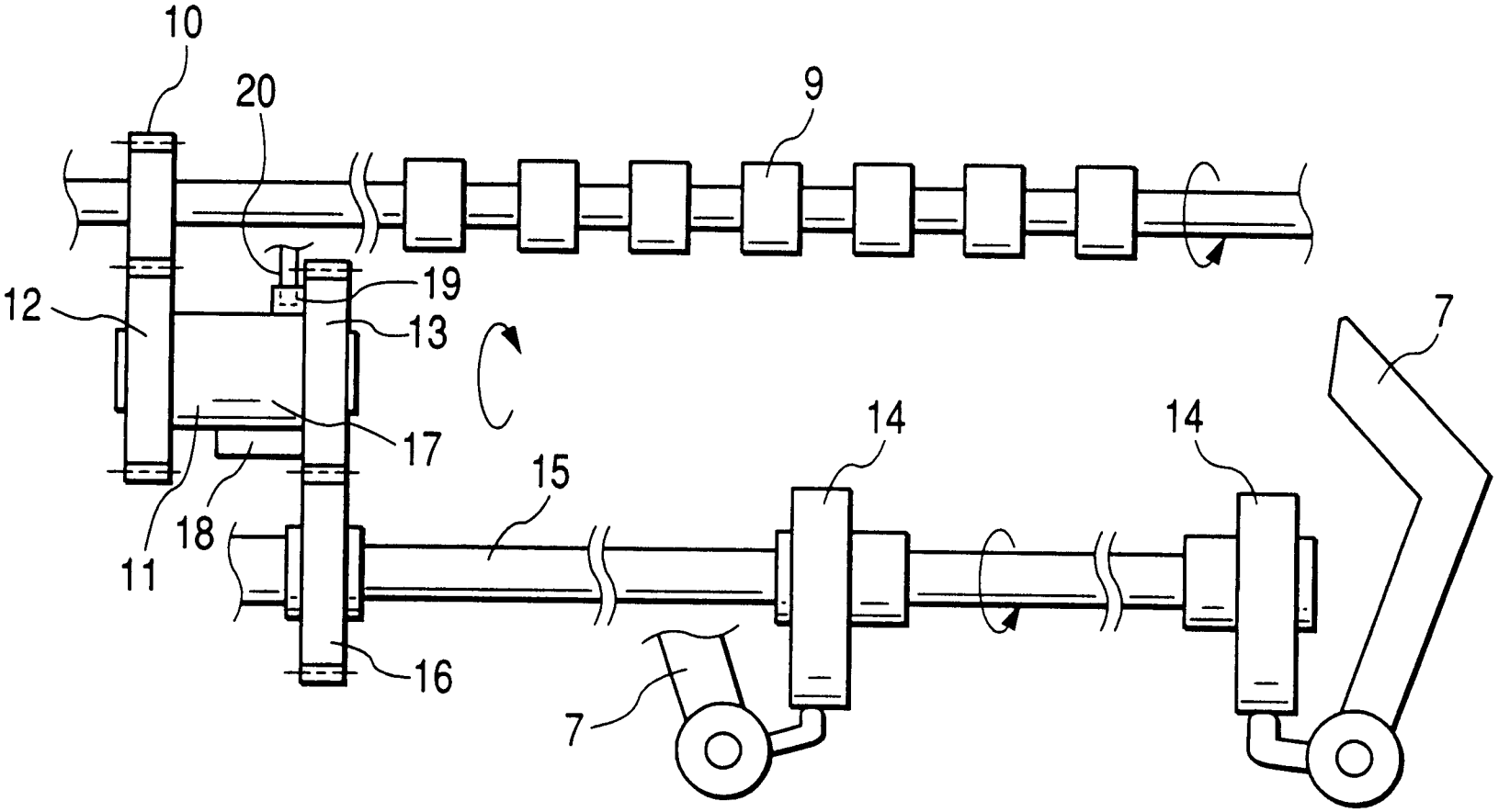
FIG. 1 is a schematic constructural view showing main parts of an image forming apparatus having a discharged sheet stacking device, according to a first embodiment of the present invention.

FIG. 1 is a schematic constructural view showing main parts (a sheet discharging portion of the image forming apparatus and a sheet holding portion of the discharged sheet stacking device) of the image forming apparatus having the discharged sheet stacking device, according to the first embodiment of the present invention.

A sheet discharging port 5 (FIG. 11) is provided with a discharge roller (discharging means) 9 for conveying and discharging a printed sheet (after image formation).

A gear (drive transmitting means) 10 for transmitting a driving force to the discharged sheet stacking device (waiting means) is attached to a shaft of the discharge roller 9.

A spring clutch unit 11 (explanation of a construction thereof will be omitted because it is well-known) constituting switching means for switching whether or not the discharged sheet stacking device is operated on the basis of information regarding a sheet print mode (described later) is provided on a stage subsequent to the gear 10.

The spring clutch unit 11 is provided at its both ends with a drive input gear 12 and a drive output gear 13, respectively.

The gear (discharging means side gear) 10 mounted on the shaft of the discharge roller is meshed with the drive input gear 12.

Further, the drive output gear 13 is meshed with a gear (sheet holding means side gear) 16 provided on a cam shaft 15 holding cams 14 for opening and closing support members (openable and closable members) 7 of sheet holding means of the discharged sheet stacking device.

Incidentally, the support members 7 effect an opening and closing operation in one cycle when the cams 14 are rotated through one revolution.

Further, a control cylinder 17 for effecting drive switching of the clutch is disposed between the drive input gear 12 and the drive output gear 13 of the spring clutch unit 11.

Next, regarding the above-mentioned construction, sheet discharging and the opening and closing operation of the support members 7 will be explained.

In the following explanation, regarding rotational directions of the rollers and gears, directions shown by the arrows are referred to as forward directions (same as a sheet conveying direction during the printing) based on the rotational direction of the discharge roller 9.

Figure 2A:
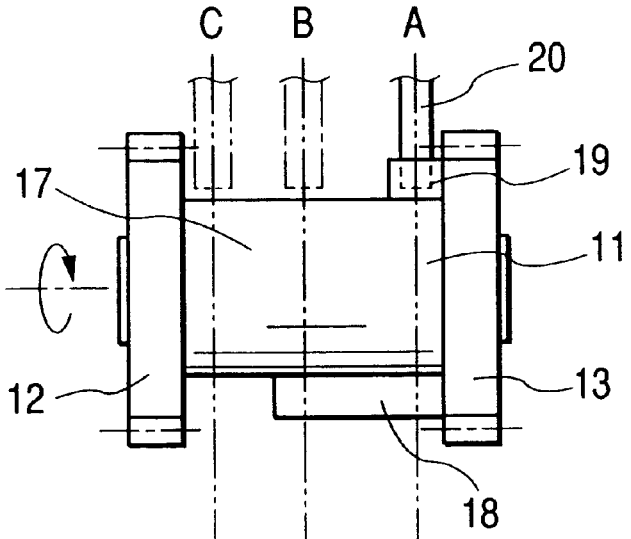
FIG. 2A is a view showing a clutch unit, according to the first embodiment.
Figure 2B:
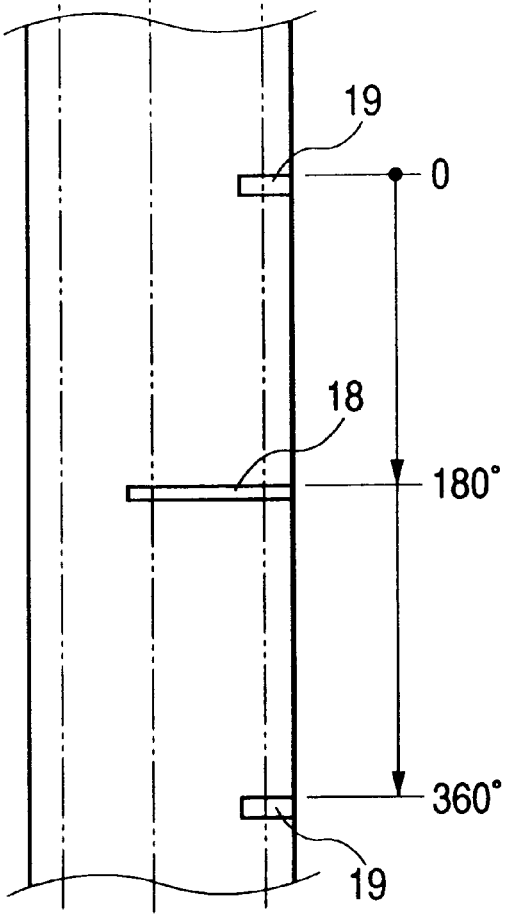
FIG. 2B is a development view of a control cylinder.

FIG. 2A is a view showing the spring clutch unit 11, and FIG. 2B is a development view of the control cylinder 17.

A trigger 30 for acting on the spring clutch unit 11 to control transmission of a driving force is disposed opposingly to the control cylinder 17. The trigger 30 will be fully described later in connection with FIGS. 3A and 3B.

Stoppers 18, 19 capable of abutting against an actuator 20 of the trigger 30 are protruded from a surface of the control cylinder 17.

The stoppers 18, 19 are spaced through 180° and disposed on the peripheral surface of the control cylinder 17 in a diametrically opposed relationship, and axial lengths of the stoppers are determined so that the stopper 18 abuts against the actuator 20 when the actuator is positioned at positions A and B on the control cylinder 17 and the stopper 19 abuts against the actuator 20 when the actuator is positioned at the position A on the control cylinder 17.

When the discharge roller 9 is rotated in a (reverse) direction opposite to the forward direction in the sheet conveyance, idle rotation is generated in the spring clutch unit 11 so as not to rotate the drive output gear 13, with the result that the driving force is not transmitted.

When the discharge roller 9 is rotated in a (forward) direction the same as the forward direction in the sheet conveyance, if the control cylinder 17 is not obstructed at all (actuator 20 does not abut against the stoppers 18, 19), the driving force is transmitted in the spring clutch unit 11 to rotate the drive output gear 13, with the result that the driving force is transmitted to the cams 14 and the support members 7 of the discharge sheet stacking device through the gear 16.

However, even when the roller is rotated forwardly, if the stopper 18 or 19 abuts against the actuator 20 of the trigger, a drive transmitting path is formed so that the idle rotation is generated in the spring clutch unit 11 so as not to rotate the drive output gear 13.

Figure 3A:
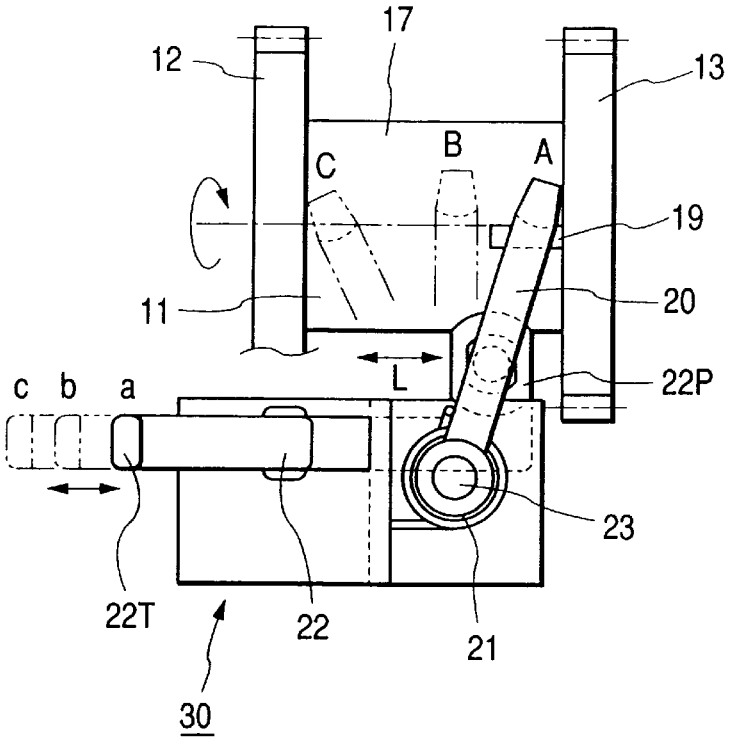
FIG. 3A is a partially cutaway plan view showing a trigger and a clutch portion, according to the first embodiment.

FIG. 3A is a partially cutaway plan view showing the trigger 30 and the spring clutch unit 11.

As shown in FIG. 3A, the trigger 30 can be engaged with the stoppers 18, 19 provided on the control cylinder 17 and includes the actuator 20 having a rotation center 23, a spring 21 for biasing the actuator 20 to the position A (FIG. 3A) in a normal state, and a lever 22 connected to the actuator 20 through a connecting portion 22P and adapted to move the actuator 20.

The lever 22 and the actuator 20 are connected to each other through the connecting portion 22P so that, when the actuator 20 is positioned at the position A on the control cylinder 17, a distal end portion 22T of the lever 22 is in a position a. Further, the connecting portion 22P is held by the trigger 30 for movement in a direction indicated by the arrow L in FIG. 3A.

Figure 3B:
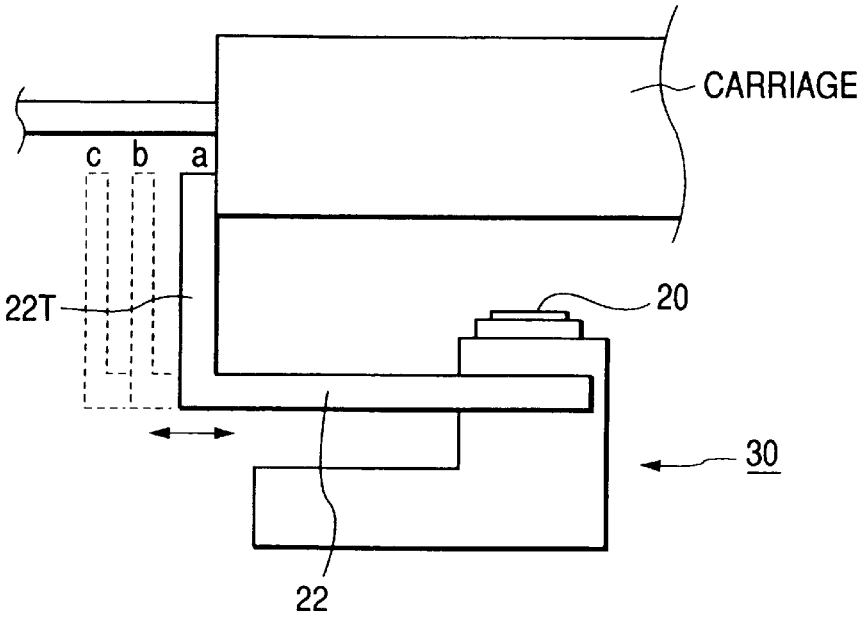
FIG. 3B is a side view of the trigger of FIG. 3A.

FIG. 3B is a side view of the trigger 30 of FIG. 3A. Although the distal end portion 22T of the lever 22 is situated at a position where it can abut against the carriage 1 (a scanning member (refer to FIG. 10) on which a head for discharging ink toward the sheet and which is adapted to effect scanning) constituting the image forming means provided above the trigger 30, since the distal end portion is located out of a scanning range of the carriage 1 during the printing operation, while the image is being formed on the sheet by the head, the distal end portion 22T of the lever 22 does not abut against the carriage 1, with the result that the actuator 20 is not moved.

When the carriage 1 is further moved from the print scanning range toward the lever 22, the distal end portion 22T of the lever 22 is pushed by the carriage 1 to be moved to a position b and then to a position c (FIG. 3B). When the lever 22 is moved, the connecting portion 22P of the lever 22 is also moved so that the actuator 20 is moved toward the positions B, C (FIG. 3A) around the rotation center 23.

In this case, the positions a, b, c (FIGS. 3A and 3B) of the lever 22 correspond to the positions A, B, C of the actuator 20, respectively.

Figure 4A:
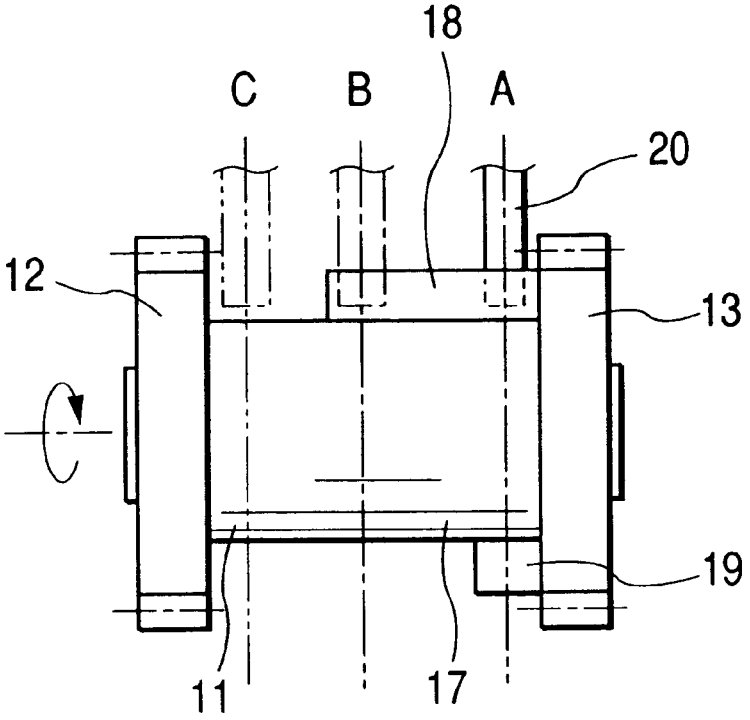
FIG. 4A is a schematic constructural view of the clutch unit in a state in which support members are opened, according to the first embodiment.
Figure 4B:
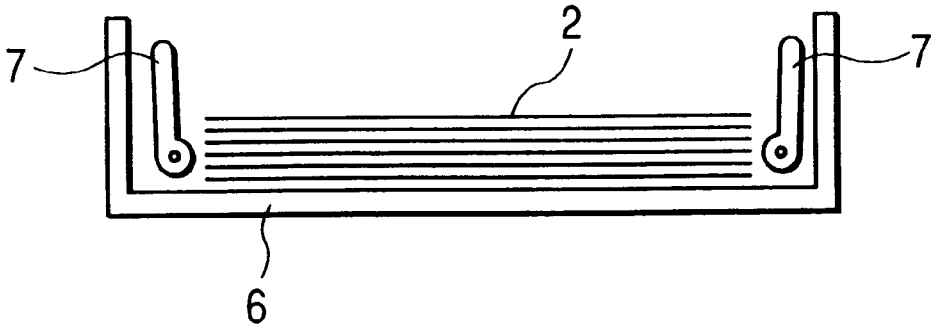
FIG. 4B is a schematic constructural view showing postures of the support members.

A state of the spring clutch unit 11 obtained when the support members 7 are opened for holding the sheet discharged from the sheet discharging port 5 is shown in FIG. 4A.

Phases of the control cylinder 17 of the spring clutch unit 11 and of the cams 14 for driving the support members 7 are selected so that, when the actuator 20 abuts against the stopper 18, the support members 7 are opened, with the result that the discharged sheet is not held by the support members 7 but directly drops onto the discharged sheet stacking position (containing portion).

Figure 5A:
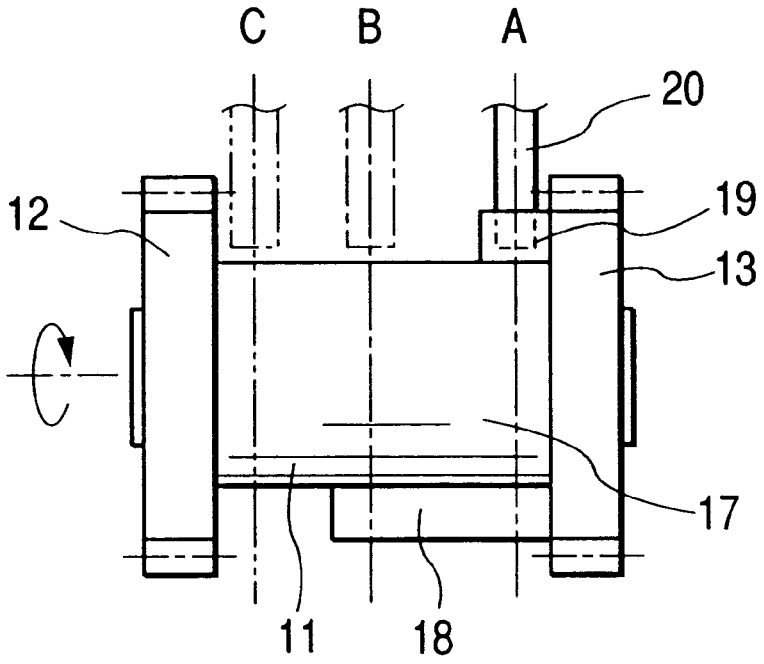
FIG. 5A is a schematic constructural view of the clutch unit in a state in which support members are closed, according to the first embodiment.
Figure 5B:
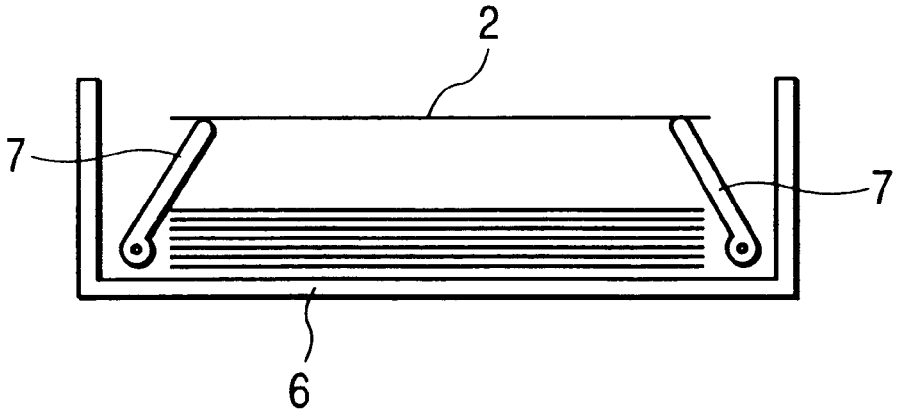
FIG. 5B is a schematic constructural view showing postures of the support members.

Further, as shown in FIGS. 5A and 5B, in a state of the spring clutch unit 11 (FIG. 5A) obtained when the support members 7 are closed, the phases are selected so that the stopper 19 abuts against the actuator 20.

Figure 6:
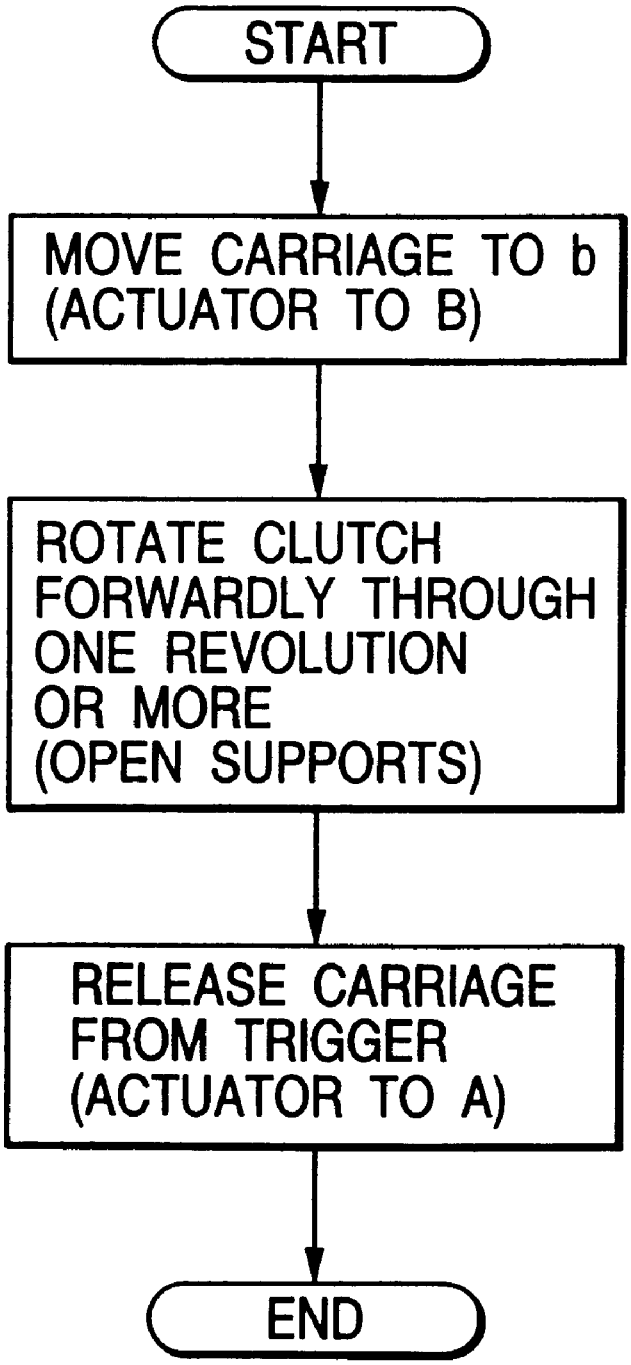
FIG. 6 is a flowchart showing a setting operation in print waiting, according to the first embodiment.

Now, an operation of the discharged sheet stacking device 7 in a print waiting state in which the image formation is not effected in the image forming apparatus will be explained with reference to a flowchart shown in FIG. 6.

When the printing is not effected in the image forming apparatus, it is required that the support members 7 be opened, because of the fact that, if accidental external force acts on the support members 7, so long as the support members 7 are opened, the damage of the support members is minimized.

Namely, as mentioned above, it is required that the actuator 20 be maintained in a state in which the actuator 20 abuts against the stopper 18 at the position A as shown in FIG. 4A.

In order to open the support members 7, the actuator 20 may abut against the stopper 18. To do so, first of all, the carriage 1 is pushed while abutting against the distal end portion 22T of the lever 22 unit and the distal end portion 22T of the lever 22 reaches the position b. As a result, the actuator 20 is also moved to the position B in FIG. 3A. Then, the spring clutch unit 11 is rotated in the forward direction through one revolution or more. By rotating the spring clutch unit 11 through one revolution or more, even when the actuator 20 is located in any position before rotation, the actuator 20 can abut against the stopper 18 without fail.

After the actuator 20 abuts against the stopper 18, by releasing the carriage 1 from the distal end portion 22T of the lever 22, the actuator 20 is moved to the position A in FIG. 3A and is stopped there. In this way, the support members 7 are opened in the print waiting state.

Figure 7:
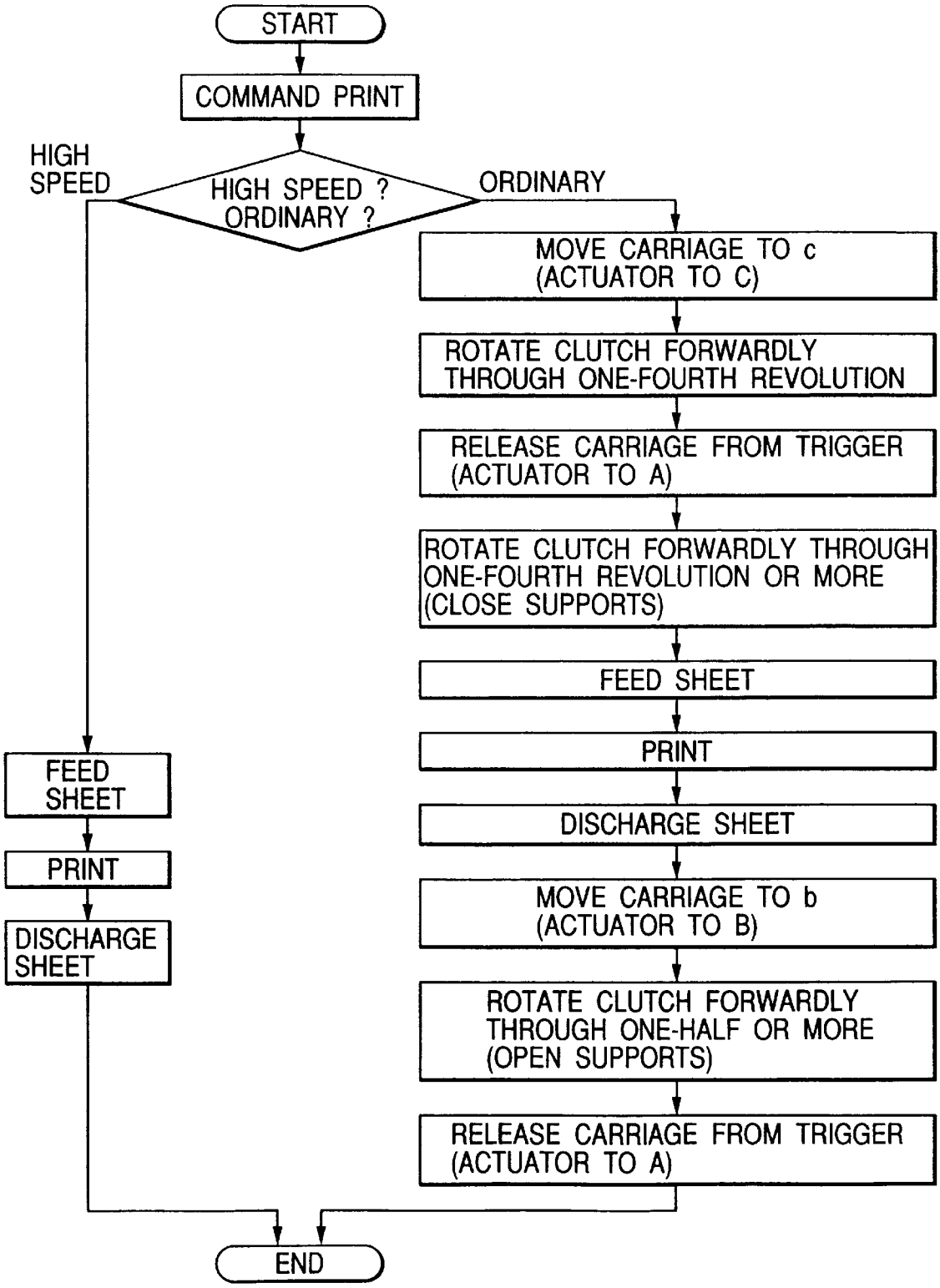
FIG. 7 is a flowchart showing a printing operation, according to the first embodiment.

Next, an operation of the discharged sheet stacking device in the image formation (during the printing) will be explained with reference to a flowchart shown in FIG. 7.

In the ink jet printer, printing contents and printing method sent from an external host electrically connected to the printer by a cable and the like is inputted to a controller (not shown) in the printer to start the printing operation. In this case, there is provided control means for controlling the operation of the support members 7 of the discharged sheet stacking device in accordance with the printing method (image forming method) commanded from the host. That is to say, the control means determines whether the discharged sheet holding function of the support members 7 is started or not on the basis of the printing method commanded from the host, and the operation of the discharged sheet stacking device is effected on the basis of such determination.

When the commanded printing method is a high speed print mode, the lever 22 is not pushed by the carriage 1, and, in the state of the spring clutch unit 11 obtained in the print waiting state, i.e., in the state that the support members 7 are opened, the printing is effected. Accordingly, the printing operation is simplified and the printing time is shortened.

Next, a case where the commanded printing method is a high image quality print mode will be explained.

In the waiting state, since the support members 7 are opened, it is required that the sheet feeding be started after the support members 7 are closed.

In order to close the support members 7 from the opened state, on the basis of a signal from the control means, the carriage 1 is moved to abut against the distal end portion 22T of the lever 22, thereby moving the actuator 20 to the position C. As a result, the engagement between the actuator 20 and the stopper 18 is released. In this state, when the forward rotation driving is inputted to the drive input gear 12, the spring clutch unit 11 is enabled to transmit the driving force to the drive output gear 13.

Then, the spring clutch unit 11 is rotated in the forward direction through about ¼ revolution. By this rotation, the driving force is transmitted to the cam shaft 15, thereby rotating the cams 14.

Then, the engagement between the distal end portion 22T of the lever 22 and the carriage 1 is released to return the actuator 20 to the position A. Thereafter, by rotating the spring clutch unit 11 in the forward direction through ¼ revolution or more, the actuator 20 can about against the stopper 19 without fail. By rotating the actuator 20 until the actuator 20 abuts against the stopper 19, the cams 14 are rotated, thereby closing the support members 7.

Thereafter, the sheet to be printed is fed from a cassette or a sheet feeder, and an image is formed on the sheet by discharging the ink onto the sheet. The sheet on which the image was formed is discharged from the sheet discharging port 5 onto the closed support members 7 and held by the support members 7.

Then, the support members 7 are opened to stack the sheet held on the support members 7 on the containing portion 6. By abutting the carriage 1 against the distal end portion 22T of the lever, the actuator 20 abutting against the stopper 19 is moved to the position B. In a state that the engagement between the actuator 20 and the stopper 19 is released, the spring clutch unit 11 is rotated in the forward direction through ½ revolution or more, the actuator 20 can abut against the stopper 18 without fail. By rotating the spring clutch unit 11 until the actuator 20 abuts against the stopper 18, the driving force is transmitted to the cam shaft 15, thereby rotating the cams 14. By this rotation, the support members 7 can be moved from the closed state to the open state.

After the above-mentioned operations, the sheet held on the support members 7 drops onto the containing portion 6 and is stacked on the previous sheets. Pursuant to this sheet stacking operation, when an image is formed on a sheet in the high image quality print mode, the closing operation of the support members 7 may be effected repeatedly.

In this way, by controlling operations of the switching means, the drive transmitting means and the carriage 1 which drive the support members 7 by means of the control means, the sheet (before the ink is dried) is held by the support members 7, thereby preventing the print surface of the sheet from abrading.

As mentioned above, by switching the operation of the support members 7 of the discharged sheet stacking device in response to the print mode, the processing speed can be enhanced in the high speed print mode, and, the operation of the support members 7 can be controlled on the basis of the printing method commanded from the host in order to prevent the contamination of the sheet in the high image quality print mode.

Incidentally, in the illustrated embodiment, while an example that the discharged sheet on which the image was formed is not held by the support members 7 in the high speed print mode, and the sheet is held by the support members 7 in the high image quality print mode was explained, the present invention is not limited to such an example, but, also in the high speed print mode, the sheet may be controlled to be held and the opening of the support members 7 may be controlled so that the sheet can be contained in the containing portion within a time period smaller than the holding time period in the high image quality print mode.

Further, in the illustrated embodiment, while an example that the present invention was explained in connection with two modes, i.e., high speed print mode and high image quality print mode, the present invention is not limited to only such modes, but, it should be noted that the operation of the support members 7 can be controlled in a mode such as a standard print mode between these two modes.

(Second Embodiment)

Figure 8:
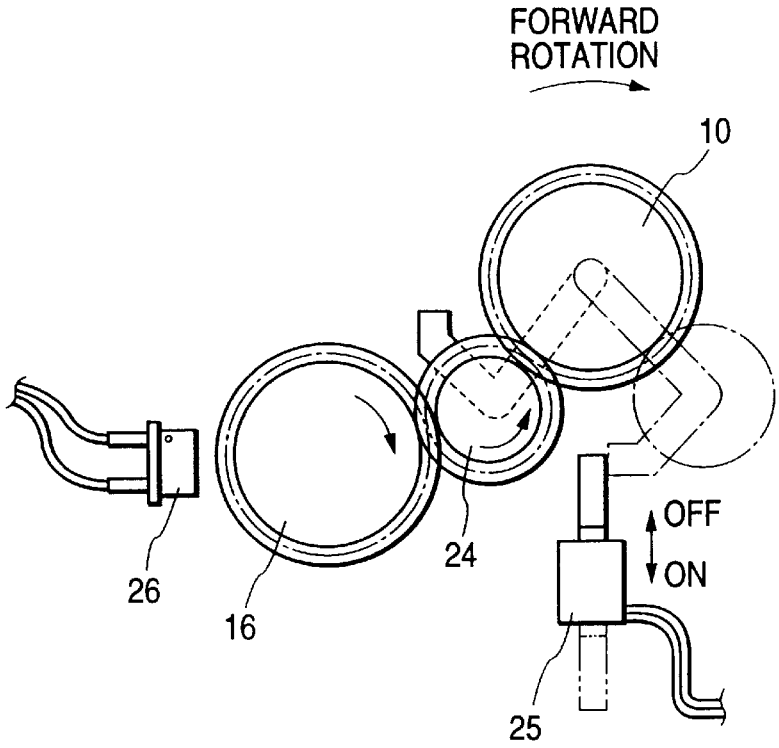
FIG. 8 is a schematic constructural view showing main parts of a discharged sheet stacking device according to a second embodiment of the present invention.
Figure 9:
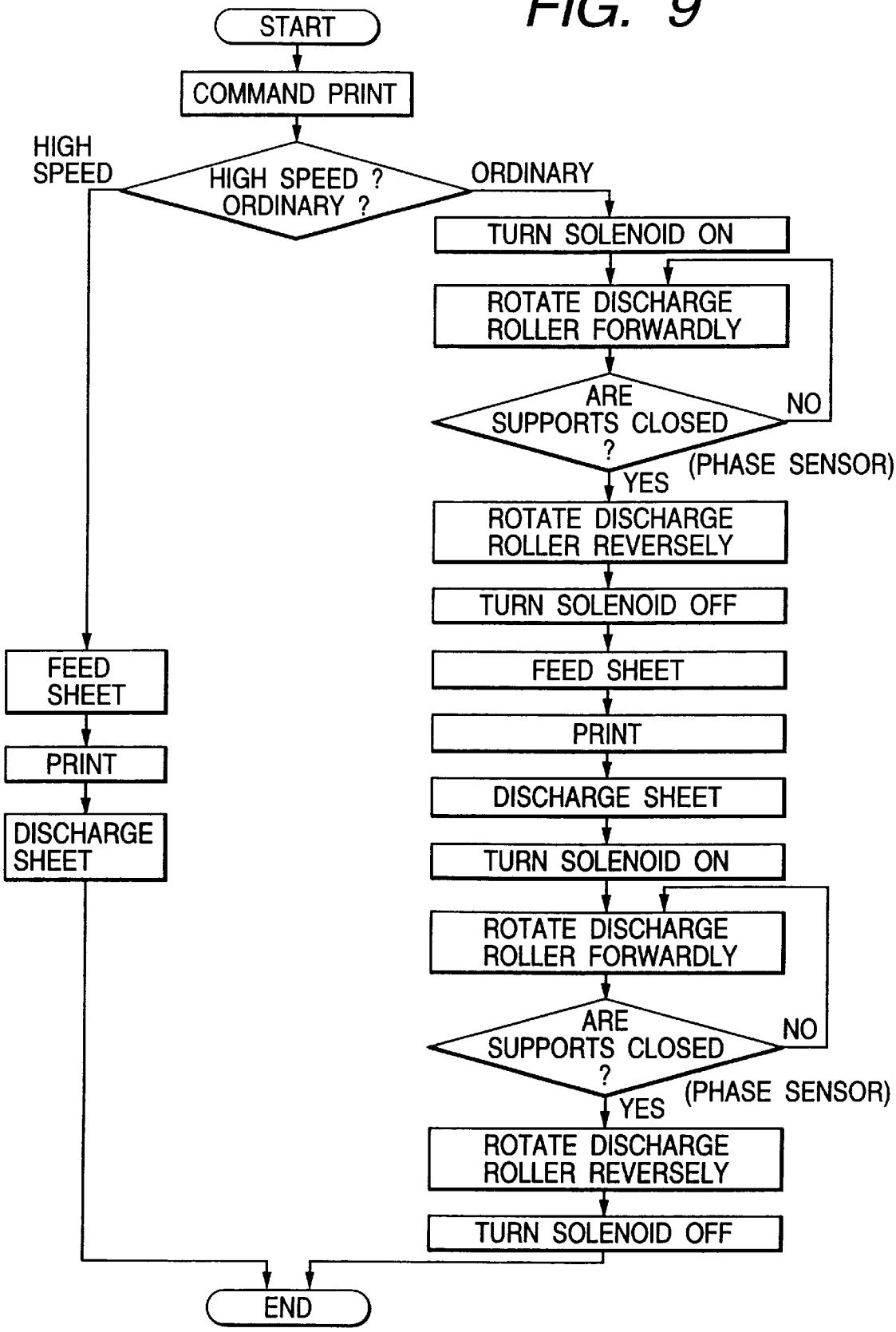
FIG. 9 is a flowchart showing a printing operation, according to the second embodiment.

FIGS. 8 and 9 show a second embodiment of the present invention. In this second embodiment, switching means for switching the operation (holding function) of the support members (sheet holding means) 7 differs from that in the first embodiment.

Since constructions and functions other than those of the switching means are the same as those in the first embodiment, elements same as those in the first embodiment are designated by the same reference numerals and explanation thereof will be omitted.

FIG. 8 is a schematic constructural view showing a main part (switching means) of a discharged sheet stacking device according to the second embodiment of the present invention.

A pendulum gear (connecting gear) 24 rotatable around the shaft of the discharge roller and meshed with the gear 10 is provided on the shaft of the discharge roller. When the discharge roller 9 is rotated in the reverse direction, the pendulum gear 24 is moved away from the gear 16 on the cam shaft 15, with the result that the driving force is not transmitted to the cam shaft 15 (connection releasing state). When the discharge roller 9 is rotated in the forward direction, the pendulum gear 24 swings toward the gear 16 to connect the gear 10 to the gear 16. This action can be controlled by a solenoid 25 which can be engaged by a shaft of the pendulum gear 24.

As shown by the phantom line in FIG. 8, in a state that the solenoid 25 is turned OFF, the pendulum gear 24 is inhibited from moving toward the gear 16.

Further, a sensor 26 for detecting a phase of the cams 14 is provided in the vicinity of the cam shaft 15 so that a state of the discharged sheet stacking device can be detected and confirmed by control means (not shown) on the basis of a detection signal from the sensor 26.

Now, an operation of the discharged sheet stacking device having the above-mentioned switching means during the printing will be explained with reference to a flowchart shown in FIG. 9.

As mentioned above, in the print waiting state, it is required that the support members 7 be opened. In the illustrated embodiment, in order to open the support members 7, first of all, in response to the command from the control means, the discharge roller 9 is rotated in the forward direction. Then, the solenoid 25 is turned ON to release the engagement between the pendulum gear 24 and the solenoid 25, thereby connecting the gear 16 to the gear 10. In this state, the driving force is transmitted to the cam shaft 15 for driving the support members 7. When the phase of the cams 14 in which the support members 7 are opened is detected by the sensor 26, the rotation of the discharge roller 9 is stopped. Thereafter, by rotating the discharge roller 9 in the reverse direction, the connection of the pendulum gear 24 is released, and the solenoid 25 is turned OFF, thereby preventing the movement of the pendulum gear 24.

In this way, the support members 7 can be opened.

When the printing system commanded from the host is the high speed print mode, the solenoid 25 is maintained in the OFF state, with the result that the sheet on which the image was formed and which is discharged from the sheet discharging port 5 is stacked in the containing portion 6 in the state that the support members 7 are opened.

Thus, in the high speed print mode, the printing operation is simplified to shorten the printing time.

Next, the high image quality print mode will be explained. When the high image quality print mode is commanded from the host, first of all, it is required that the opened support members 7 be closed. To this end, firstly, the discharge roller 9 is rotated in the forward direction to turn the solenoid 25 ON, with the result that the regulation of the pendulum gear 24 is released, thereby drivingly connecting the gear 16 to the gear 10. In this state, by further rotating the discharge roller 9 in the forward direction, the driving force is transmitted to the cam shaft 15, thereby rotating the cams 14 to close the support members 7.

When the fact that the support members 7 are closed is detected by the sensor 26, the discharge roller 9 is rotated in the reverse direction to attain the connection releasing state of the pendulum gear 24, and the solenoid 25 is turned OFF to prevent the movement of the pendulum gear 24.

In this way, the support members 7 are moved from the open state to the closed state, with the result that the sheet discharged from the discharge roller 9 is held by the support members 7.

Then, the support members 7 are opened in order to stack the sheet held on the support members 7 on the containing portion 6. In order to change the support members 7 from the closed state to the open state, the operation same as the operation for bringing the print waiting state may be performed. That is to say, after the discharge roller 9 is rotated in the forward direction, the solenoid 25 is turned ON to move the pendulum gear 24 to obtain the drive connecting state, thereby transmitting the driving force to the cam shaft 15. The cams 14 are rotated until the support members 7 reach the open state. When the phase of the cams 14 in this state is detected by the sensor 26, the discharge roller 9 is rotated in the reverse direction to release the drive connecting state, and then, the solenoid 25 is turned OFF.

By controlling the operation of the support members 7 in this way, the sheet (before the ink is dried) is held by the support members 7, thereby preventing the print surface of the preceding sheet from abrading.

As mentioned above, by switching the operation of the support members 7 of the discharged sheet stacking device in response to the print mode, the processing speed can be enhanced in the high speed print mode, and, the operation of the support members 7 can be controlled on the basis of the printing method commanded from the host in order to prevent the contamination of the sheet in the high image quality print mode.

As fully mentioned above, also in the second embodiment, the same effect as the first embodiment can be achieved.

Incidentally, in the above-mentioned embodiment, while an example that the driving force for rotating the discharge roller 9 is used for opening and closing the support members 7 was explained, the present invention is not limited to such an example.

Further, in the illustrated embodiments, while an example that the support members (openable and closable members) 7 are always opened in the high speed print mode not to hold the discharged sheet was explained, the present invention is not limited to such an example, but, also in the high speed print mode, the discharged sheet may be controlled to be held and the opening of the support members 7 may be controlled so that the sheet can be contained in the containing portion within a time period smaller than the holding time period in the standard print mode. By effecting such controls, the print surface of the sheet can be prevented from abrading more positively.

Further, so long as the support members 7 can be moved between the first position where the sheet is held by the support members and the second position where the sheet is not held by the support members, the support members may have any shapes or configurations.

In addition, in the illustrated embodiments, while an example that the control means controls the operation of the discharged sheet stacking device and the image forming operation on the basis of the image forming method commanded from the host was explained, the present invention is not limited to such an example, but, the support members may be manually switched between the sheet holding position and the sheet non-holding position.

Further, the image forming apparatus having the image forming means for effecting the image formation and the discharged sheet stacking device may be constituted as units, respectively.

What is claimed is:

1. An image forming apparatus comprising:

image forming means for forming an image on a sheet;

discharging means for discharging the sheet on which the image is formed by said image forming means;

containing means for containing the sheet discharged from said discharging means;

sheet holding means holding the sheet before the discharged sheet is contained in said containing means; and switching means for switching a holding of said sheet holding means for the discharged sheet in response to an image forming method for the sheet.

2. An image forming apparatus according to claim 1, further comprising drive transmitting means for transmitting a driving force of said image forming means to said switching means, and operating means for driving said sheet holding means with the driving force transmitted from said drive transmitting means through said switching means.

3. An image forming apparatus according to claim 2, wherein said drive transmitting means transmits a driving force of said discharge means for discharging the sheet on which the image is formed to said switching means.

4. An image forming apparatus according to claim 2, wherein said switching means switches transmission and non-transmission of the driving force transmitted from said drive transmitting means to said operating means for driving said sheet holding means.

5. An image forming apparatus according to claim 4, wherein said drive transmitting means is constituted by a gear, and said switching means has a gear meshed with said gear of said drive transmitting means and a gear for transmitting the driving force to said operating means, and said image forming apparatus further comprises a clutch member to which the driving force is transmitted from said drive transmitting means, and a trigger member for switching a clutch of said clutch member.

6. An image forming apparatus according to claim 5, wherein said trigger member has an actuator for switching transmission and non-transmission of the driving force transmitted from said drive transmitting means to said operating means, and said actuator can be engaged with a stopper provided on said clutch member.

7. An image forming apparatus according to claim 6, wherein said trigger member can abut against a carriage for scanning in a direction perpendicular to a sheet feeding direction in order to form the image on the sheet, so that said actuator is operated by engaging or disengaging said carriage with respect to said trigger member.

8. An image forming apparatus according to claim 2, wherein said switching means has a connecting gear for effecting and releasing connection between said drive transmitting means and said operating means, and a solenoid mechanism for driving said gear.

9. An image forming apparatus according to claim 8, wherein said switching means has a sensor for detecting a state of said operating means to determine a timing of said connecting gear for effecting and releasing the connection between said drive transmitting means and said operating means.

10. An image forming apparatus according to claim 2, wherein said operating means has a cam for abutting against said sheet holding means to drive said sheet holding means, a cam shaft for rotatably supporting said cam, and a gear provided on said cam shaft and meshed with said gear of said switching means.

11. An image forming apparatus according to claim 10, wherein said sheet holding means has openable and closable members to be opened or closed by said cam of said operating means, so that the sheet discharged from said discharging means is held by said openable and closable members in a closed state, and the sheet is dropped onto and contained in said containing means when said openable and closable members are in an open state.

12. An image forming apparatus according to claim 11, wherein, in an image formation waiting state of the image forming apparatus, said switching means and said operating means are driven to bring said openable and closable members of said sheet holding means to said open state.

13. An image forming apparatus according to any one of claims 1 to 12, wherein said image forming means has a high speed image forming method of effecting the image formation at a high speed, so that, when the image formation is effected in said high speed image forming method, the discharged sheet is not held by said sheet holding means.

14. An image forming apparatus according to claim 1, wherein said image forming means is of ink jet image forming method in which the image is formed on the sheet by discharging ink onto a surface of the sheet.

15. An image forming apparatus comprising:

image forming means for forming an image by discharging ink onto a sheet;

containing means for containing the sheet on which the image is formed by said image forming means; and waiting means for waiting the sheet on which the image is formed by said image forming means before the sheet is contained in said containing means; wherein said waiting means has control means for changing a waiting state of the sheet on which the image is formed by said image forming means, based on an image forming method of said image forming means for forming the image on the sheet.

16. An image forming apparatus according to claim 15, wherein said control means effects control for changing the waiting state of said waiting means in response to an amount of ink discharged onto the sheet by said image forming means and an image forming speed.

17. An image forming apparatus according to claim 15, further comprising discharging means for discharging the sheet on which the image is formed to contain the sheet in said containing means, and wherein said waiting means waits the sheet on which the image is formed and which is discharged from said discharging means, before the sheet is contained in said containing means.

18. An image forming apparatus according to claim 17, wherein said waiting means has a holding means for holding the sheet on which the image is formed, before the sheet on which the image is formed and which is discharged from said discharging means is contained in said containing means.

19. An image forming apparatus according to claim 18, wherein said holding means is movable under control of said control means between a first position where the sheet discharged from said discharging means is held and waited and a second position where the sheet is not held.

20. An image forming apparatus according to claim 15, further comprising switching means for changing the waiting state of said waiting means based on control of said control means, and drive transmitting means for transmitting a driving force of the image forming apparatus to said switching means, and wherein said switching means moves a holding means by transmitting and non-transmitting of the driving force from said drive transmitting means to said waiting means.

21. An image forming apparatus according to claim 20, wherein said drive transmitting means is constituted by a gear, and said switching means has a gear meshed with said gear of said drive transmitting means, and said image forming apparatus further comprises a clutch member for transmitting the driving force from said drive transmitting means to said waiting means, and a trigger member engagable with said clutch member and for switching drive transmission from said clutch member to said waiting means.

22. An image forming apparatus according to claim 21, wherein said trigger member can abut against a carriage for scanning in a direction perpendicular to a sheet feeding direction in order to form the image on the sheet, so that said clutch member is operated by engaging or disengaging said carriage with respect to said trigger member, thereby switching the drive transmission to said switching means.

23. An image forming apparatus according to claim 20, wherein said switching means has a connecting gear for effecting and releasing connection between said drive transmitting means and said waiting means, and a solenoid mechanism for driving said connecting gear, and said connecting gear is operated under control of said control means, thereby moving said holding means of said waiting means.

24. An image forming apparatus according to claim 23, wherein said control means has a sensor for detecting a state of said holding means, and said switching means is operated in response to a detection signal from said sensor.

25. An image forming apparatus according to claim 20, wherein said holding means of said waiting means has a cam rotated by a driving force transmitted from said switching means, a cam shaft for supporting said cam, and a gear provided on said cam shaft and meshed with a gear of said switching means.

26. An image forming apparatus according to any one of claims 15 to 25, wherein said image forming means has a high speed image forming method of effecting the image formation at a high steed, so that, when the image formation is effected in said high speed image forming method, said waiting means is not operated to contain the sheet in said containing means without waiting the sheet.

27. An image forming apparatus according to any one of claims 15 to 25, wherein said image forming means has a high image quality image forming method of forming an image on the sheet with high image quality, so that, when the image formation is effected in said high image quality image forming method, said waiting means is operated to wait the sheet, thereafter containing the sheet in said containing means.

28. An image forming apparatus according to claim 15, wherein said image forming means, said waiting means and said containing means are constituted as units, respectively.

29. A controlling method comprising the steps of:

forming an image on a sheet by image forming means;

containing the sheet on which the image is formed by said image forming means in containing means; and changing a time period from a time when the image is formed on the sheet to a time when the sheet is contained in said containing means, in response to an image forming method of said image forming means.

30. A controlling method according to claim 29, wherein said image forming means is of ink jet type for forming the image by discharging ink onto the sheet, and wherein a time period for containing the sheet on which the image is formed in said containing means is controlled to satisfy a relationship $T1<T2$, where $T1$ is a time period from a time when the image is formed on the sheet to a time when the sheet is contained in said containing means when the image forming method of said image forming means is a high speed image forming method of effecting the image formation at a high speed and $T2$ is a time period from a time when the image is formed on the sheet to a time when the sheet is contained in said containing means when the image forming method of said image forming means is a high image quality image forming method of forming an image on the sheet with high image quality.

31. A controlling method according to claim 30, further comprising the step of temporarily waiting the sheet on which the image is formed by waiting means before the sheet is contained in said containing means, and wherein a time period of said waiting means for waiting the sheet is controlled.

32. A controlling method according to claim 31, wherein, when the image forming method of said image forming means is the high speed image forming method, the sheet is contained in said containing means without waiting the sheet by said waiting means.

* * * * *

UNITED STATES PATENT AND TRADEMARK OFFICE

CERTIFICATE OF CORRECTION

PATENT NO. : 6,164,206
DATED : December 26, 2000
INVENTOR(S) : Yoshida

It is certified that error appears in the above-identified patent and that said Letters Patent is hereby corrected as shown below:

Title page,
Item [56] References Cited, U.S. PATENT DOCUMENTS, "Watanabi et al." should read -- Watanabe et al. --.

Column 12,
Line 60, "steed," should read -- speed, --.

Signed and Sealed this

First Day of January, 2002

*Attest:*

*Attesting Officer*

JAMES E. ROGAN
*Director of the United States Patent and Trademark Office*